US005807512A

United States Patent [19]

Grant

[11] Patent Number: 5,807,512

[45] Date of Patent: Sep. 15, 1998

[54] CARBURETOR WITH REPLACEABLE BOOSTER VENTURIS

[76] Inventor: Barry Grant, Rte. 1, Box 1900, Dahlonega, Ga. 30533

[21] Appl. No.: 824,420

[22] Filed: Mar. 26, 1997

Related U.S. Application Data

[63] Continuation-in-part of Ser. No. 801,721, Feb. 14, 1997.

[51] Int. Cl.[6] ..... F02M 9/14; F02M 19/10

[52] U.S. Cl. ..... 261/23.2; 261/34.1; 261/78.1; 261/DIG. 12; 261/DIG. 39; 261/DIG. 56

[58] Field of Search ..... 261/34.1, 23.2, 261/78.1, DIG. 39, DIG. 56, DIG. 12

[56] References Cited

U.S. PATENT DOCUMENTS

| | | | |
|---|---|---|---|
| 1,390,681 | 9/1921 | Edwards | 261/DIG. 12 |
| 1,562,126 | 11/1925 | Saives | 261/DIG. 12 |
| 1,631,716 | 6/1927 | Baverey | 261/DIG. 12 |
| 2,007,337 | 7/1935 | Mallory | 261/DIG. 56 |
| 3,539,157 | 11/1970 | Fort | 261/34.1 |
| 4,118,444 | 10/1978 | Abbey | 261/DIG. 56 |
| 4,187,805 | 2/1980 | Abbey | 261/DIG. 56 |
| 4,250,856 | 2/1981 | Abbey | 261/DIG. 39 |
| 4,308,835 | 1/1982 | Abbey | 261/DIG. 56 |
| 4,375,438 | 3/1983 | McKay | 261/23.2 |
| 4,387,685 | 6/1983 | Abbey | 261/23.2 X |
| 4,559,185 | 12/1985 | Seto et al. | 261/DIG. 56 |

OTHER PUBLICATIONS

HB Books, Weber Carburetors, Pat Braden, 3 Pages, 1988.

*Primary Examiner*—Richard L. Chiesa
*Attorney, Agent, or Firm*—Thomas, Kayden, Horstemeyer & Risley

[57] ABSTRACT

A booster venturi (21) is removably mounted to the barrel (11) of a carburetor (10), with the venturi ring (26) concentrically located in the barrel. The support conduit (28) extending from the venturi ring (26) terminates in a threaded end that protrudes through a fuel port (50) in the sidewall of the carburetor. A connector nut (30) is threaded onto the threaded end of the support conduit (28), to seat the protrusion (40) about the support conduit (28) in the correspondingly shaped and sized recess (42) in the sidewall (46) of the carburetor. The connector tool (80) has a probe (84) that fits the internal passage (32) of the support conduit, and tool protrusions (86) that engage the tool bores (72) of the connector nut (30) so that the nut can be mounted first on the tool (80) and then the nut can be properly positioned in the fuel port (50) and rotated about the threaded end of the support conduit (28) to precisely and rigidly mount the venturi ring (26) concentrically in the barrel of the carburetor.

11 Claims, 4 Drawing Sheets

CARBURETOR WITH REPLACEABLE BOOSTER VENTURIS

CROSS REFERENCE TO RELATED APPLICATIONS

This application is a continuation-in-part of U.S. patent application Ser. No. 08/801,721, filed Feb. 14, 1997.

FIELD OF THE INVENTION

This invention relates to carburetors for internal combustion engines for high performance vehicles. More particularly, the invention relates to a carburetor having interchangeable and replaceable parts, including booster venturis which are removably suspended in the fuel induction passages of a multiple barrel carburetor.

BACKGROUND OF THE INVENTION

Carburetors for high performance internal combustion engines of the type used for racing vehicles and drag racers usually are of very large capacity, and are relatively expensive. The large volume carburetors are used to induce a large volume of fuel flow from a supply to the cylinders of the internal combustion engine.

In order to enhance the fuel supply capacity of a carburetor, it has become common to suspend a booster venturi ring in each flow passage or throat of a multiple barrel carburetor. The booster venturi communicates with the supply of fuel and the passage of air through the booster venturi induces the fuel to flow from the supply into the air stream which is directed to the engine.

Each booster venturi includes a booster ring and a support conduit connected to the booster ring and extending away from the booster ring, with the distal end of the conduit being connected by swaging or other permanent connection to the fuel opening in the sidewall of the center section of the carburetor. When the booster venturis are mounted to the carburetor, the swaging action causes some deformation of the facing surfaces of the fuel conduit of the booster venturi and to the fuel opening in the sidewall of the carburetor, but once swaged in place, the booster venturi is rigidly maintained in a fixed position.

It is common in high performance racing vehicles to modify the configuration of the engine and its fuel supply system to change the performance of the vehicle. In some instances, the configuration of the booster venturis would be changed, if possible.

It is difficult to change the configuration of a booster venturi in a typical carburetor structure because the venturis are rigidly mounted to the center section of the carburetor housing, and the carburetors usually are worked on while in place. In some instances, a change of configuration of the booster venturi is accomplished by adding or deleting material from the venturi surfaces. This means that the typical amateur mechanic experiences the hazard of fracturing or otherwise damaging the booster venturi and/or the carburetor to which it is mounted while working on the booster venturi, and possibly dropping bolts, screws, tools and other items into the carburetor and possibly even into the engine.

It is highly desirable to provide carburetors with removable and replaceable booster venturis so that maintenance and repair functions can be performed on the booster venturis away from the carburetor and the engine of the performance vehicle. Further, it would be desirable to be able to exchange booster venturis in a carburetor structure so as to utilize booster venturis having larger or smaller interior dimensions, with larger or smaller conduits and venturi rings for supplying different volumes of fuel being induced by the flow of air through the carburetor.

SUMMARY OF THE INVENTION

Briefly described, the present invention comprises a carburetor for a high performance internal combustion engine having a replaceable booster venturi structure, whereby the booster venturis in a multiple barrel carburetor which are suspended in the barrels of the center section of the carburetor can be releasably mounted to the carburetor in a preset attitude which is suitable for maximum performance, but which can be removed from the carburetor for maintenance, repair or replacement, particularly for replacement with a different size booster venturi. This can be achieved without hazard of damage to the carburetor, and with the ability to expediently remount substitute booster venturis to the carburetor, even by a semi-skilled, non-professional mechanic.

The replaceable booster venturis each include a venturi ring to be placed in the air passage or throat of a carburetor, and a support conduit that is connected at one of its ends to the venturi ring and extends away from the venturi ring and terminates in an externally threaded end portion. A locating collar is formed adjacent the threads of the support conduit, and the conduit and its locating collar are shaped to fit a recess in the interior surface of the sidewall of the throat of the center section of the carburetor, so as to precisely locate the venturi ring concentrically within the confines of the cylindrical throat of the carburetor. The threaded end of the support conduit of the booster venturi fits into the fuel inlet port formed in the sidewall of the center section of the carburetor.

An internally threaded connector nut is sized and shaped to be received in the fuel inlet port at the outside of the sidewall of the carburetor and the internal threads of the nut engage with and connect to the external threads of the support conduit. The annular external shape of the connector nut corresponds to the facing shape of the fuel inlet port, so that as the nut and fuel inlet port are drawn together as the nut is screwed onto the support conduit, a seal is made between the connector nut and the sidewall of the center section of the carburetor.

The connector nut includes a conically tapered annular bearing surface and the annular surface about the fuel inlet port facing the nut also is conically tapered, and the depth of the tapered surface about the fuel inlet port from the external wall of the carburetor is sufficient to completely receive the connector nut, so that when installed, the annular flat surface of the head of the connector nut is substantially coextensive with the external surface of the sidewall of the center section of the carburetor. With this arrangement, no protrusion is formed on the sidewall of the center section of the carburetor.

The annular outwardly facing surface of the connector nut includes tool receiving bores or receptacles which can be engaged by an installation tool. In the preferred embodiment, the connector nut defines a threaded central opening and the tool receiving bores are radially spaced from the threaded center opening and are positioned in an annular symmetrical array of 2, 3, or 4 bores. With this arrangement, the connector nuts can be rotated by engaging the tool bores with an installation tool so as to pull the threaded end of the support conduit of the booster venturi on through the fuel inlet port, with the threaded end of the conduit extending almost completely through the connector nut, and the exposed end of the support conduit will not interfere with the use of the tool to rotate the connector nut.

A tool is provided for installation and removal of the booster venturis, which comprises a central positioning probe sized to fit into the opening of the support conduit, at the exposed end of the support conduit, and protrusions arranged in an annular array about the probe, which are sized, shaped and positioned to engage the tool receiving bores of the connector nut.

Another feature of the invention is that a prior art carburetor having permanently installed booster venturis can be modified so as to accept the replaceable booster venturis, by removing the permanently installed booster venturis and by boring new surfaces about the fuel inlet ports. It is not necessary to form threads in the fuel inlet ports of the carburetor since the threads of the support conduit extending from the venturi ring will mate with the threads of the connector nut in a compression fit at the sidewall of the carburetor.

Thus, it is an object of this invention to provide a carburetor with replaceable booster venturis releasably mounted to the center section of the carburetor housing, with each booster venturi ring properly suspended in a throat of the carburetor.

Another object of this invention is to provide a carburetor for internal combustion engines that includes removable booster venturis which can be replaced with booster venturis of different sizes and shapes substantially without hazard of damaging the carburetor or the booster venturis, and without requiring the use of tools or other objects such as screws and nuts in the interior of the carburetor, so as to avoid the hazard of inadvertently dropping objects into the carburetor.

Another object of the invention is to provide a booster venturi with a connector nut and connector tool, with the connector tool being sized and shaped for expediently installing the connector nut to the booster venturi and to the carburetor which is to receive the booster venturi.

Another object of the invention is to provide a design of a carburetor with booster venturis so that a carburetor of previous design having permanently installed booster venturis can be modified so as to replace the permanently installed booster venturis with replaceable booster venturis.

Another object of the invention is to provide booster venturis which can be removably mounted to a carburetor, with the venturi rings of the booster venturis precisely suspended in the throat of the carburetor.

Other objects, features, and advantages of the present invention will become apparent upon reading the following specification, when taken in conjunction with the accompanying drawings.

DETAILED DESCRIPTION

Figure 1:
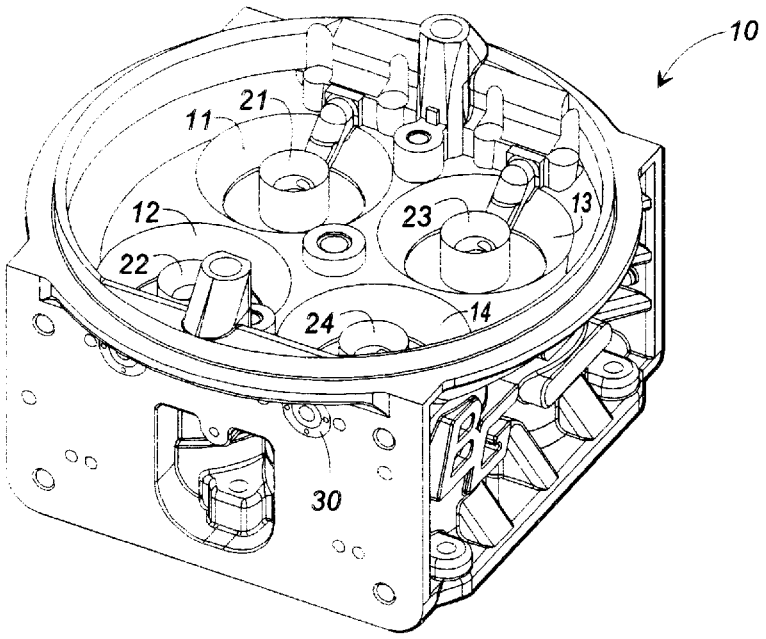
FIG. 1 is a perspective illustration of a four barrel carburetor for an internal combustion engine, showing a replaceable booster venturi mounted in each one of the throats of the carburetor.
Figure 2:
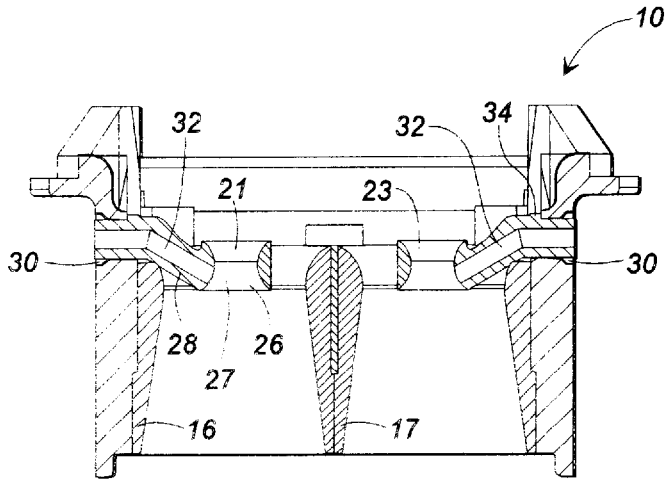
FIG. 2 is a side cross-sectional view of the four barrel carburetor of FIG. 1, taken through a pair of the barrels of the carburetor, showing the booster venturis added in the throats.
Figure 3:
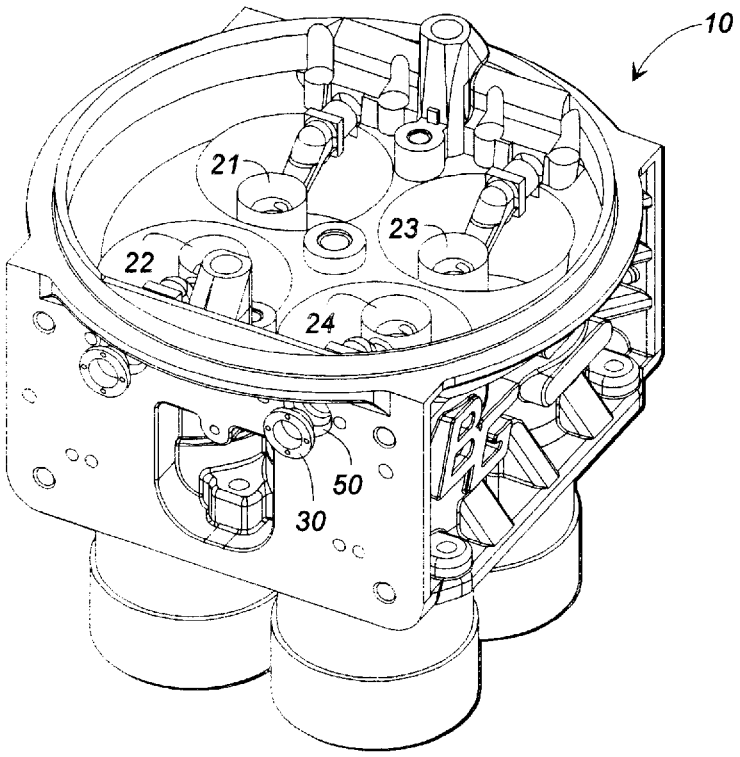
FIG. 3 is another perspective illustration of the four barrel carburetor of FIG. 1, showing the booster venturis and the venturi sleeves partially removed, so as to indicate the manner in which these elements fit together.

Referring now in more detail to the drawings, in which like numerals indicate like parts throughout the several views, FIG. 1 illustrates a carburetor 10 that includes four throats 11, 12, 13, and 14 that function as air passages for passing air from the atmosphere, through a filter, through the carburetor, and then to an internal combustion engine. The throats 11–14 of the carburetor are formed by removable venturi sleeves such as sleeves 16 and 17 of FIG. 2, which are more fully disclosed in the prior copending U.S. patent application 08/801,721.

Replaceable booster venturis 21, 22, 23 and 24 are positioned concentrically in the throats of the carburetor. Each booster venturi includes a venturi ring 26, a support fuel supply conduit 28, and a connector nut 30. The shape of the venturi ring 26 is of conventional design, with a progressively formed constriction that increases the velocity of the air moving through the venturi ring, thereby decreasing the pressure in the venturi ring and drawing fuel through the support conduit 28.

The support fuel supply conduit 28 includes an internal passage 32 which extends lengthwise therethrough, intersecting at one end the constricted opening 27 of the venturi ring, and opening at the other end outside of the sidewall of the center section of the carburetor 10.

Figure 6:
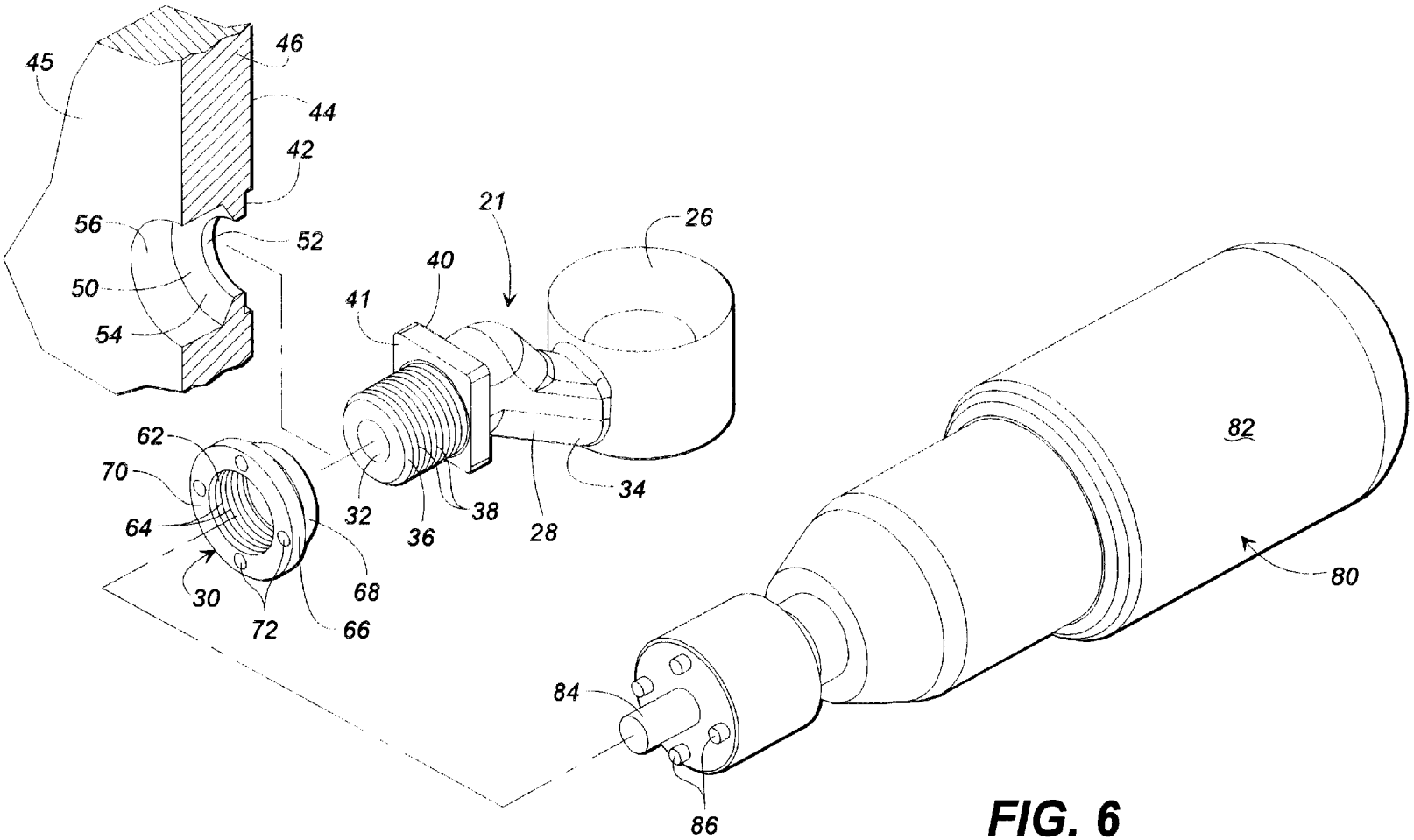
FIG. 6 is an expanded view of the booster venturi and its connector nut, and the connector tool, as they would be used to mount the booster venturi to the sidewall of a throat of the carburetor.

As best shown in FIG. 6, the support conduit 28 has the first one of its ends 34 mounted to the venturi ring 26, and the opposed, second end 36 is formed with external spiral threads 38. A positioning protrusion 40 extends outwardly from the support conduit, and is located between the external spiral threads 38 and the venturi ring 26.

A recess 42 in the interior surface 44 of the sidewall 46 is sized and shaped so as to correspond with and interfit with the size and shape of the positioning protrusion 40, so that the bearing surface 41 of the positioning protrusion will abut with the recess 42. The interfitting shapes of the recess 42 and the positioning protrusion will precisely locate and orient the booster venturi with the throat of the carburetor.

A fuel port 50 is formed through the sidewall 46 of the carburetor, and the threaded second end 36 of the support conduit 28 protrudes into the fuel port 50. The fuel port includes a cylindrical bore 52 adjacent the interior surface 44 and its positioning recess 42 of the sidewall 46, an intermediate beveled counterbore 54, and an outer cylindrical counterbore 56 which intersects the external surface 45 of the sidewall 46 of the carburetor.

Connector nut 30 includes a substantially cylindrical central opening 62 with spiral threads 64 formed thereon, a cylindrical outer surface 66, a tapered annular bearing surface 68 and an external annular flat surface 70 that surrounds the central opening 62. The cylindrical central opening 62 is sized and shaped to fit the second end 36 of the support conduit 28, and its threads 64 are formed in a thread design that mates with the threads 38 of the second end of the support conduit. The tapered bearing surface 68 corresponds in size and shape to the intermediate beveled counterbore 54 of the fuel port 50. With this arrangement, when the second end of the support conduit 28 is inserted into the fuel port, the connector nut 60 can be rotatably mounted on the spiral threads 38 of the second end of the support conduit, pulling the support conduit into the fuel port 50, until the bearing surface 41 of the positioning protrusion 40 engages the recess 42 on the interior surface 44 of the sidewall 46 of the carburetor. The interfitting relationship between the positioning protrusion 40 and the recess 42 is such that the venturi ring 26 will be accurately oriented in the barrel of the carburetor, and no amount of vibration or jarring of the carburetor will cause the booster venturi to be moved out of its proper position.

The depth of the outer cylindrical counterbore 56 of the fuel port 50 is such that the fuel port will receive the entire positioning nut 30, so that the external annular flat surface 70 of the connector nut will be substantially coextensive with the external surface 45 of the sidewall of the carburetor. A plurality of bores 72 which function as tool receptacles are formed in external annual flat surface 70 of the connector nut 30. The bores are formed in an annular symmetrical array which is concentric with the cylindrical central opening 62 of the connector nut 30. The bores 72 are used to rotate the connector nut, in the manner described hereinafter.

A connector tool 80 is elongated and includes at one end a handle 82 and at its other end a positioning probe 84 and a plurality of tool protrusions 86 which are formed in an annular array about the probe 84. Probe 84 is sized and shaped so as to fit in the internal passage 32 of the support conduit 28, while the tool protrusions 86 which surround probe 84 are sized, shaped and positioned to engage with the tool bores 72.

Figure 4:
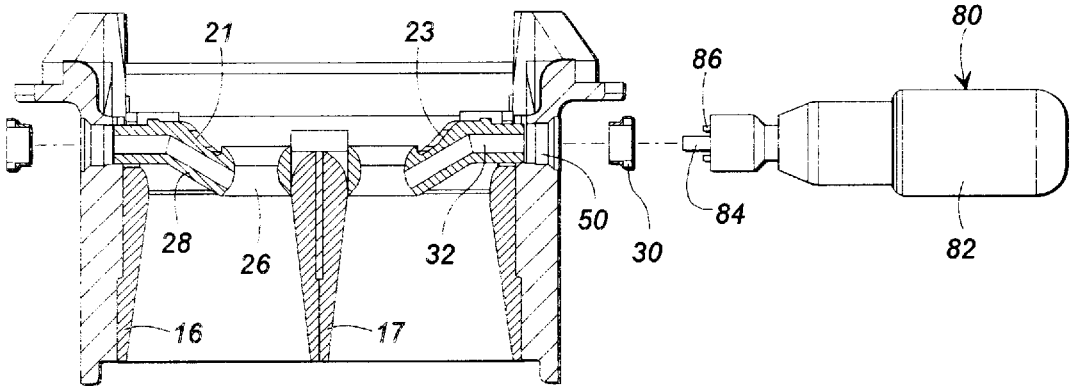
FIG. 4 is a side cross-sectional view of the carburetor of FIG. 3, showing the booster venturis partially removed from the carburetor, and showing the mounting tool and how it is aligned with the connector nut.
Figure 5:
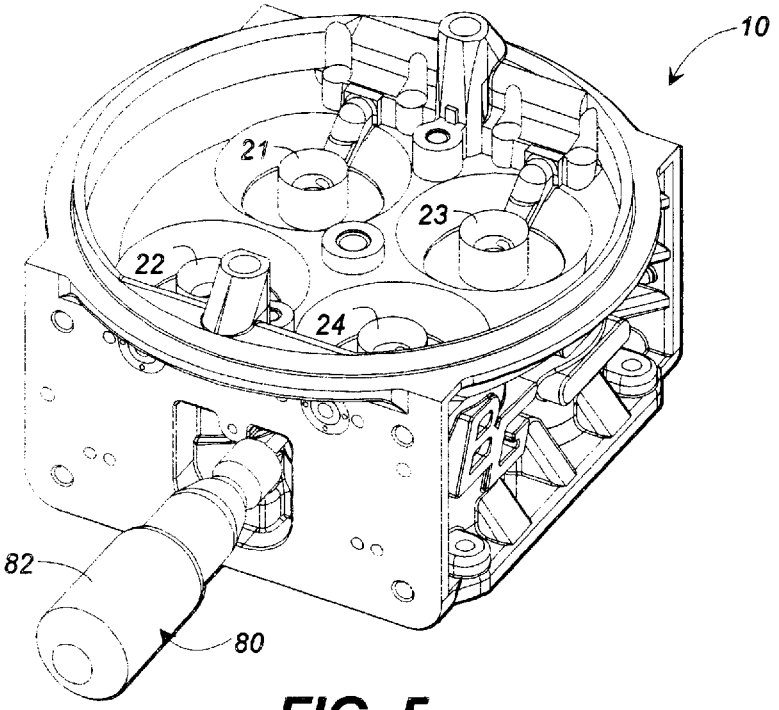
FIG. 5 is another perspective illustration of the carburetor, showing the connector tool aligned with but displaced from the connector nut of one of the booster venturis.

With this arrangement, it can be seen from FIGS. 4, 5 and 6 that the connector nut 30 can be fitted onto the probe 84 and protrusions 86 of the connector tool 80 with the tool protrusions 86 extending into the tool bores 72, thereby holding the connector nut in the correct position on the tool. In the meantime, the operator can place a booster venturi, such as the booster venturi 23 of FIG. 4, into alignment with the fuel port 50, so that its positioning protrusion 40 becomes aligned with the positioning recess 42 which is formed about the fuel port 50 on the interior surface 44 of the carburetor sidewall. The booster venturi 23 is then urged telescopically into the fuel port 50 until the bearing surface 41 of the positioning protrusion 40 seats in the recess 42, which properly aligns and positions the venturi ring 26 in its carburetor barrel. The operator then moves the connector tool 80 with the connector nut 30 mounted thereon toward the fuel port 50 from outside the carburetor until its positioning probe 84 becomes aligned with the internal passage 32 of the support conduit 28 of the booster venturi, which aligns the array of tool protrusions 86 of the tool with the array of tool bores 72. The operator can then rotate the tool 80 until the tool protrusions engage with the tool bores 72, whereupon the connector nut 30 will rotate in unison with the tool. The rotation of the connector nut 30 causes its threads 64 to engage with and pull the nut onto the threads 38 of the second or distal end of the support conduit 28, causing the tapered bearing surface 68 of the connector nut to engage against the intermediate beveled counterbore 54 of the fuel port 50. This frictional engagement will lock the venturi ring 26 in its proper position.

While the connector tool 80 and the connector nut 30 are both shown with four interengaging bores and protrusions, it will be understood that fewer or more tool bores 72 and tool protrusions 86 can be used if desired. Further, the bores and protrusions have been illustrated as being cylindrical; however, other non-circular shapes can be used, if desired.

It will be noted that the connection of the connector nut 30 with the support conduit 28 of the venturi ring is accomplished without requiring threads to be placed in the surface of the fuel port 50, which provides simplicity of design and construction, yet accomplishes a static connection between all three of the sidewall, support conduit and connector nut. The positioning probe 84 functions as a locator for the connector tool 80, so that the connector nut is expediently and accurately mounted to the support conduit 28, without requiring the support conduit 28 to protrude outwardly from the sidewall of the carburetor. Further, the positioning protrusion 40 functions as a positioning means to assure that the venturi ring 26 is properly located; however, while the positioning protrusion is formed as a rectangular collar, other collar shapes or half-collar shapes or other shaped protrusions can be used to function as a positioning means, as long as the recess 42 that receives the positioning means is of complementary interengaging shape.

Although preferred embodiments of the invention have been disclosed in detail herein, it will be obvious to those skilled in the art that variations and modifications can be made without departing from the spirit and scope of the invention as set forth in the following claims.

I claim:

1. A carburetor for an internal combustion engine, comprising:

a sidewall having an interior surface defining an air passage for the movement therethrough of air from the atmosphere to an internal combustion engine, and an external surface;

a fuel inlet port formed in and extending through said sidewall from said external surface to said internal surface;

a booster venturi mounted to said sidewall, said booster venturi including a venturi ring placed in said air passage, a support conduit having an internal passage extending therethrough and a first end mounted to and in fluid communication with said venturi ring and a second end extending to and in fluid communication with said fuel port and having a conduit connector means at its second end, a positioning means located on and protruding away from said support conduit between said conduit connector means and said venturi ring in engagement with said sidewall;

an external connector means releasably engaging said sidewall and said conduit connector means and releasably urging said positioning means against said sidewall without blocking the fluid passage of said support conduit;

so that said venturi ring is in fluid communication with said fuel port and fuel can be drawn from said fuel port to the venturi ring and into the air flowing through the air passage.

2. The carburetor of claim 1 and wherein:

said conduit connector means at the second end of said support conduit comprises external threads formed about said support conduit;

said external connector means comprises a nut having a substantially cylindrical opening with internal threads formed on said opening and engaging said external threads;

an annular bearing surface surrounding said cylindrical opening of complementary shape with respect to and in engagement with the external surface of said housing, and an external annular surface surrounding said cylindrical opening and substantially coextensive with the external surface of said housing.

3. The carburetor of claim 2, and wherein:

the external surface of said nut defines a plurality of tool receptacles arranged in a symmetrical array about said cylindrical opening.

4. The carburetor of claim 1, and wherein:

said positioning means comprises a collar extending about said support conduit and having a bearing surface of complementary shape with respect to and in engagement with said interior surface of said sidewall.

5. The carburetor of claim 4, and further comprising:

a tool for engaging and turning said nut, said tool including at one end a handle and at its other end a positioning probe and a tool protrusion arranged about said positioning probe and spaced and arranged to engage said tool receptacles.

6. The carburetor of claim 5, and wherein said plurality of tool protrusions comprises at least two tool protrusions.

7. The carburetor of claim 5, and wherein said plurality of tool protrusions comprises at least four tool protrusions.

8. The carburetor of claim 1, and wherein:

said fuel inlet port includes an annular beveled surface facing said external surface of said sidewall, said conduit connector means includes and annular beveled surface facing an in engagement with said beveled surface of said fuel inlet port, and said positioning means and the interior surface of the sidewall of the carburetor are of complementary, interfitting shape that maintains said venturi ring in a predetermined position in the air passage.

9. A booster venturi for mounting to a carburetor for an internal combustion engine, with the carburetor including a sidewall having an interior surface defining an air passage for the movement therethrough of air from the atmosphere to an internal combustion engine, and a fuel port formed in and extending through the sidewall, and a positioning recess formed in the sidewall about the fuel port; said booster venturi comprising:

a venturi ring for placement in the carburetor, a support conduit having an internal passage extending lengthwise therethrough and a first end mounted to and in fluid communication with said venturi ring and a second end extending away from said venturi ring for mounting in fluid communication with the fuel port of the carburetor;

said support conduit including conduit connector means at its second end, and a positioning means located on and protruding away from said support conduit and located between said conduit connector means and said venturi ring for engagement with the sidewall of the carburetor;

an external connector means releasably engaging said conduit connector means of said support conduit for releasably urging the positioning means against a sidewall of a carburetor.

10. The removable booster venturi of claim 9, and wherein:

said conduit connector means comprises threads formed about said second end of said support conduit; and said external connector means comprises a connector nut defining a cylindrical threaded central opening, a beveled bearing surface for engagement with the sidewall of the carburetor, an external surface normal to said central opening, and tool receptacles formed and arranged in a symmetrical array in said external surface about said central opening.

11. The removable booster venturi of claim 10, and further including:

a tool for engaging and turning said connector nut, said tool including at one end handle means for turning said tool and at its other end a probe of the size and shape to move into the internal passageway of said support conduit and tool protrusion means radially displaced from said probe sized and shaped to engage with said tool receptacle of said connector nut.

* * * * *